US008724824B2

(12) United States Patent
Wu

(10) Patent No.: US 8,724,824 B2
(45) Date of Patent: May 13, 2014

(54) PORTABLE ELECTRONIC DEVICE HAVING UNIVERSAL EARPHONE JACK

(75) Inventor: Hai-Zhou Wu, Shenzhen (CN)

(73) Assignees: Shenzhen Futaihong Precision Industry Co., Ltd., Shenzhen (CN); Chi Mei Communication Systems, Inc., New Taipei (TW)

( * ) Notice: Subject to any disclaimer, the term of this patent is extended or adjusted under 35 U.S.C. 154(b) by 290 days.

(21) Appl. No.: 13/046,793

(22) Filed: Mar. 14, 2011

(65) Prior Publication Data

US 2012/0128185 A1 May 24, 2012

(30) Foreign Application Priority Data

Nov. 24, 2010 (CN) ..... 2010 1 0557455

(51) Int. Cl.
*H04R 1/10* (2006.01)

(52) U.S. Cl.
USPC ..... 381/74; 381/306; 381/123; 381/384

(58) Field of Classification Search
None
See application file for complete search history.

(56) References Cited

U.S. PATENT DOCUMENTS 7,912,501 B2 * 3/2011 Johnson et al. ..... 455/556.1
2009/0296952 A1 * 12/2009 Pantfoerder et al. ..... 381/74

* cited by examiner

*Primary Examiner* — Duc Nguyen
*Assistant Examiner* — Taunya McCarty
(74) *Attorney, Agent, or Firm* — Novak Druce Connolly Bove + Quigg LLP

(57) ABSTRACT

A portable electronic device includes an earphone jack circuit for receiving an earphone plug, a control circuit and a switch circuit. The control circuit sends audio to or receives audio from the earphone plug by the earphone jack. The switch circuit is set between the earphone jack and the control circuit including a first mode and a second mode. The control circuit identifies a type of the earphone plug, and switches the switch circuit to a corresponding mode according to the type of the earphone plug.

2 Claims, 6 Drawing Sheets

PORTABLE ELECTRONIC DEVICE HAVING UNIVERSAL EARPHONE JACK

BACKGROUND

1. Technical Field

The disclosure generally relates to portable electronics devices, and particularly to a portable electronic device having a universal earphone jack, which can receive multiple earphone plugs.

2. Description of Related Art

Many portable electronic devices are widely used, such as mobile phones, MP3s, or MP4s players. Users can use an earphone to receive audio from radio or listen to music from the portable electronic devices. An earphone plug usually includes a first contact portion, a second contact portion, a third contact portion, and a fourth contact portion orderly formed thereon. Referring to FIG. 5, as a first type earphone plug, the first contact portion is a left channel point REC_L. The second contact portion is a right channel point REC_R. The third contact portion is a microphone channel point MIC. The fourth contact portion is a ground point GND. Referring to FIG. 6, as a second type earphone plug, the first contact portion is a microphone channel point MIC. The second contact portion is a left channel point REC_L. The third contact portion is a right channel point REC_R. The fourth contact portion is a ground point GND. A related portable electronic device usually can use only one of the first or the second type earphone plug, and lacks flexibility.

Therefore, there is room for improvement within the art.

BRIEF DESCRIPTION OF THE DRAWINGS

Many aspects of the present embodiment can be better understood with reference to the following drawings. The components in the drawings are not necessarily drawn to scale, the emphasis instead being placed upon clearly illustrating the principles of the present embodiment.

DETAILED DESCRIPTION

Figure 1:
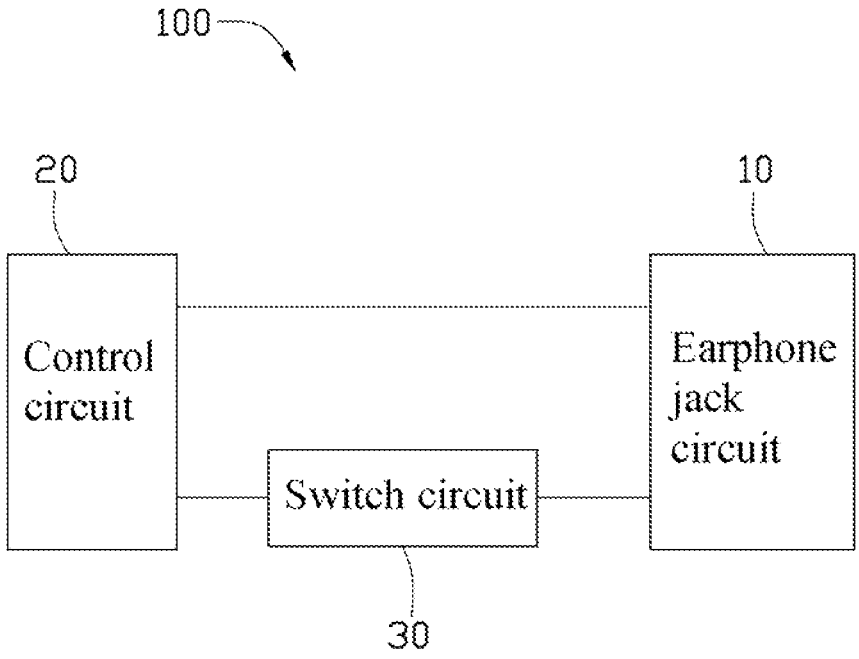
FIG. 1 is a block diagram of portable electronic device, according to an exemplary embodiment.

FIG. 1 shows a portable electronic device 100 according to an exemplary embodiment. The portable electronic device 100 includes an earphone jack circuit 10, a control circuit 20, and a switch circuit 30.

Figure 2:
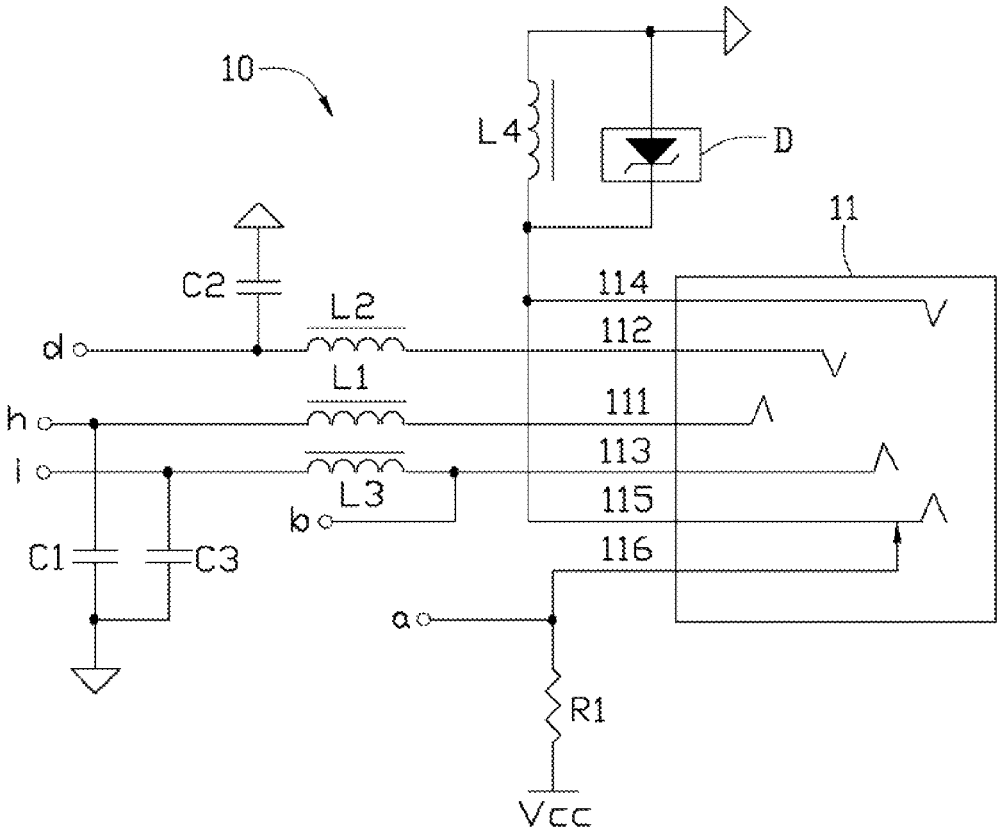
FIG. 2 is a circuit diagram of an earphone jack circuit of the portable electronic device of FIG. 1, according to an exemplary embodiment.
Figure 5:
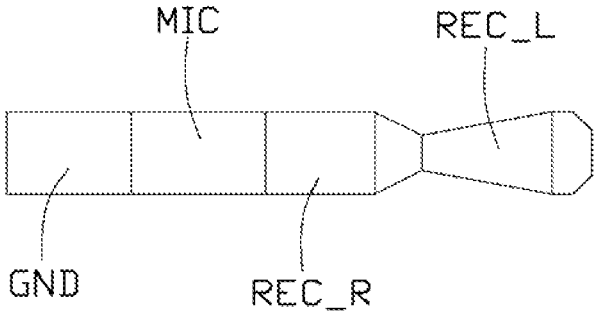
FIG. 5 (RELATED ART)
FIG. 5 is a schematic view of a related first type earphone plug.
Figure 6:
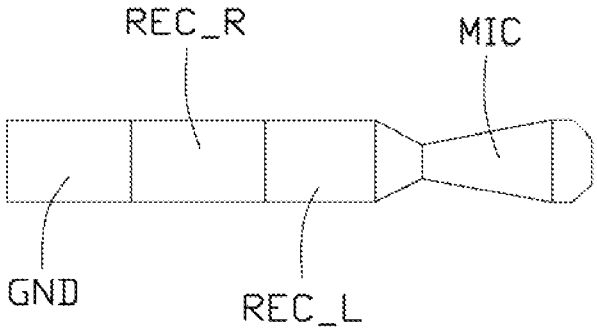
FIG. 6 (RELATED ART)
FIG. 6 is a schematic view of a related second type earphone plug.

Also referring to FIG. 2, the earphone jack circuit 10 includes an earphone jack 11. The earphone jack 11 includes a first contact 111, a second contact 112, a third contact 113, a fourth contact 114, a fifth contact 115, and a sixth contact 116. When an earphone plug such as the earphone plug shown in FIG. 5 or FIG. 6 is received in the earphone jack 11, the first, second, third and fourth contacts 111-114 are respectively connected to the first, second, third and fourth contact portions of the earphone plug, the earphone can receive audio from or send audio to the portable electronic device 100. The first contact 111 is grounded by a first conductor L1 and a first capacitor C1 connected in series. The second contact 112 is grounded by a second conductor L2 and a second capacitor C2 connected in series. The third contact 113 is grounded by a third conductor L3 and a third capacitor C3 connected in series. The fourth contact 114 is grounded by a fourth inductor L4 and a diode D connected in parallel. Therefore, static electricity which is generated when the earphone plug is inserted into the earphone jack 11 can be reduced. The fifth contact 115 is connected to the fourth contact 114. The sixth contact 116 is connected to the fifth contact 115, and also connected to a power supply Vcc by a first resistor R1. When the earphone plug is received in the earphone jack 11, the sixth contact 116 is disconnected from the fifth contact 115 and turned to a high level from a low level (e.g., from logic 1 to logic 0).

Figure 3:
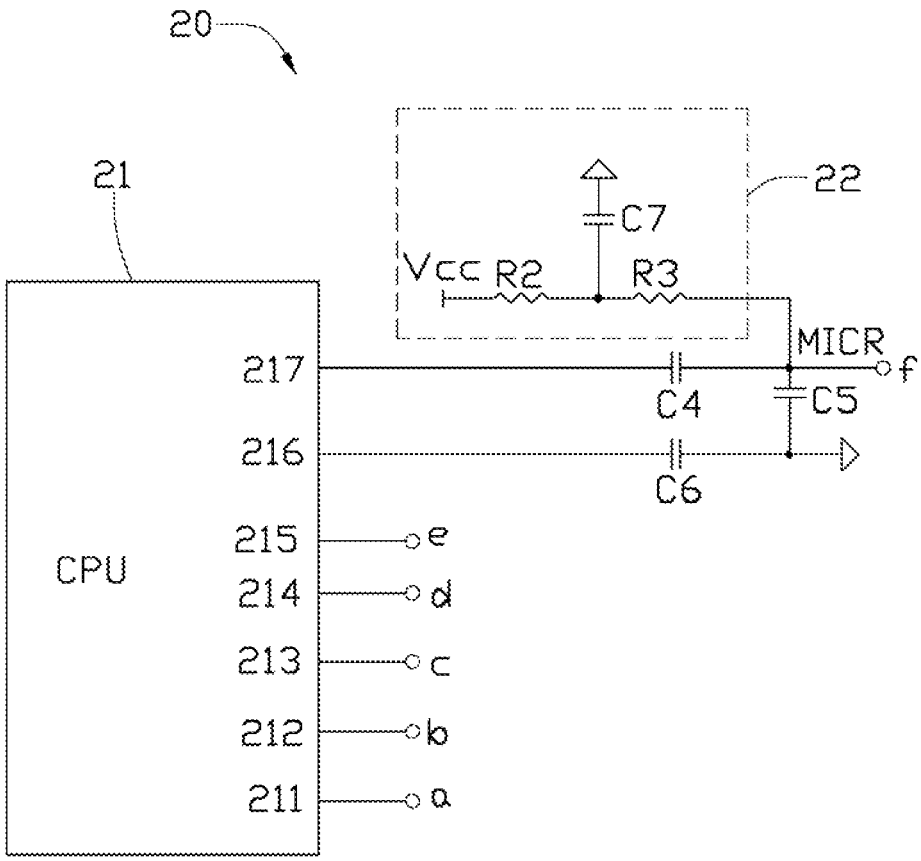
FIG. 3 is a circuit diagram of a control circuit of the portable electronic device of FIG. 1, according to an exemplary embodiment.

Also referring to FIG. 3, the control circuit 20 includes a central processing unit (CPU) 21 and a bias circuit 22 connected to the CPU 21. The CPU 21 includes a first detecting contact 211, a second detecting contact 212, a control contact 213, a left channel contact 214, a right channel contact 215, a first audio processing contact 216, and a second audio processing contact 217.

The first detecting contact 211 is connected to the sixth contact 116. The first detecting contact 211 determines whether the earphone plug is received in the earphone jack 11 according to states of the sixth contact 116.

The second detecting contact 212 is connected to the third contact 113. When the earphone plug shown in FIG. 5 or FIG. 6 is received in the earphone jack 11, the second detecting contact 212 obtains voltages of the third contact portion of the earphone plug by the third contact 113. The voltages of the third contact portions of the first type earphone plug (i.e. the microphone channel point MIC) and the second type earphone plug (i.e. the left channel point REC_L) are at different voltage ranges. Therefore, the second detecting contact 212 identifies the type of the earphone plug received in the earphone jack 11 according to the voltages of the third contact portion of the earphone plug.

The control contact 213 is connected to the switch circuit 30. The control contact 213 switches the switch circuit 30 to a corresponding mode according to the type of the earphone plug received in the earphone jack 11.

The right channel contact 214 is connected the second contact 112 (i.e. the right contact portion of the earphone plug) by the second inductor L2. The left channel contact 215 is connected to the switching unit 30. The right channel contact 214 and the left channel contact 215 send audio from the portable electronic device 100 to the earphone jack 11.

The first audio processing contact 216 is grounded. The second audio processing contact 217 is served as an audio receiving contact MICR. A fourth capacitor C4 is set between the second audio processing contact 217 and the audio receiving contact MICR. A fifth capacitor C5 is set between the audio receiving contact MICR and ground. A sixth capacitor C6 is set between the first audio processing contact 216 and ground. Audio sent from the earphone can be received by the audio receiving contact MICR.

The bias circuit 22 includes a second resistor R2, and a third resistor R3. The second resistor R2 and the third resistor R3 are connected in series between a power supply Vcc and the audio receiving contact MICR. The bias circuit 22 further includes a seventh capacitor C7. One end of the seventh capacitor C7 is connected to a node between the second resistor R2 and the third resistor R3. Another end of the seventh capacitor C7 is grounded.

Figure 4:
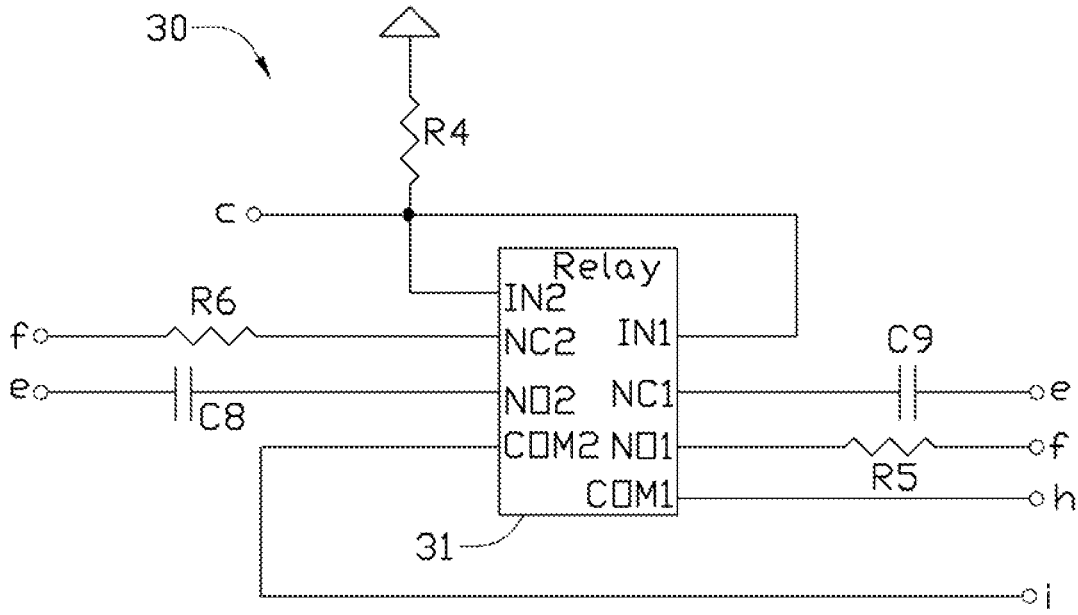
FIG. 4 is a circuit diagram of a switch circuit of the portable electronic device of FIG. 1, according to an exemplary embodiment.

Also referring to FIG. 4, the switch circuit 30 includes a relay 31. The relay 31 includes two input contacts IN1, IN2, two common contacts COM1, COM2, a first normally open contact NO1, a second normally open contact NO2, a first normally closed contact NC1 and a second normally closed contact NC2. The relay 31 includes a first mode and a second mode, in the first mode, the two common contacts COM1 and COM2 are respectively connected to the first normally closed contact NC1 and the second normally closed contact NC2. In the second mode, the two common contacts COM1 and COM2 are respectively connected to the first normally open contact NO1 and the second normally open contact NO2.

The two input contacts IN1 and IN2 are grounded by a fourth resistor R4 and also connected to the control contact 213 of the control unit 20. The two common contacts COM1 and COM2 are respectively connected to the first contact 111 and the third contact 113 of the earphone jack 11 by the first inductors L1 and the third inductor L3. The first normally open contact NO1 is connected to the audio receiving contact MICR by a fifth resistor R5. The second normally open contact NO2 is connected to the left channel contact 215 by an eighth capacitor C8. The first normally closed contact NC1 is connected to the left channel contact by a ninth capacitor C9. The second normally closed contact NC2 is connected to the audio receiving contact MICR by a sixth resistor R6.

When an earphone plug is received in the earphone jack 11, the sixth contact 116 is disconnected from the ground contact 115 and turned to a high level from a low level. The first detecting contact 212 determines that the earphone plug is received according to the states of the sixth contact 116. Next, the second detecting contact 212 obtains voltages of the third contact 113 and determines the type of the received earphone plug.

If the first type earphone plug is received in the earphone jack 11, the control contact 213 controls the relay 31 to switch to the first mode. That is, the two common contacts COM1 and COM2 are respectively connected to the two normally closed contacts NC1 and NC2. The first contact 111 and the third contact 113 are respectively connected to the left channel contact 215 and the audio receiving contact MICR of the CPU 21 by the switch circuit 30. The first type earphone plug can be used by the portable electronic device 100.

If the second type earphone plug is received in the earphone jack 11, the control contact 213 controls the relay 31 to switch to the second mode. The two common contacts COM1 and COM2 are respectively switched to the two normally open contacts NO1 and NO2. That is, the first contact 111 and the third contact 113 are respectively connected to the audio receiving contact MICR and the left channel contact 215 of the CPU 21. In addition, the second contact 112 is connected to the right channel contact 214. The second type earphone plug can be used by the portable electronic device 100. Therefore, the first type and second type earphone plugs can be freely used by the portable electronic device 100.

The first inductor L1, the first capacitor C1, the second inductor L2, the second capacitor C2, the third inductor L3, the third capacitor C3 are used to improve audio frequency response, and can be omitted in other embodiments.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A portable electronic device, comprising:

an earphone jack circuit for receiving an earphone plug, the earphone plug comprising a first contact portion, a second contact portion, a third contact portion, and a fourth contact portion orderly formed thereon; the earphone plug selected from one of a first type and a second type; the first contact portion, the second contact portion, the third contact portion, and the fourth contact of the first type earphone plug serving as a left channel point, a right channel point, a microphone channel point and a ground point, respectively; the first contact portion, the second contact portion, the third contact portion, and the fourth contact of the second type earphone plug serving as a microphone channel point, a left channel point, a right channel point, and a ground point, respectively; wherein the earphone jack circuit comprises an earphone jack, the earphone jack comprises a first contact, a second contact, a third contact, and a fourth contact; the fourth contact is grounded;

a control circuit sending audio to or receiving audio from the earphone plug by the earphone jack; wherein the control circuit includes a central processing unit (CPU), the CPU includes a control contact, a right channel contact connected to the second contact, a left channel contact and an audio receiving contact; and a switch circuit set between the earphone jack and the control circuit, the switch circuit including a first mode and a second mode; wherein the switch circuit comprises a relay, the relay comprises two input contacts connected to the control contact, two common contacts connected to the first contact and third contact, a first normally open contact connected to the audio receiving contact, a second normally open contact connected the left channel contact, a first normally closed contact connected the left channel contact, and a second normally closed contact connected to the audio receiving contact; in the first mode, the first contact is connected to the left channel contact, the third contact is connected to the audio receiving contact; in the second mode, the first contact is connected to the audio receiving contact and the third contact is connected to the left channel contact; the control circuit identifies whether the received earphone plug is the first type or the second type, and switches the switch circuit to the first mode or the second mode according to the type of the earphone plug.

2. The portable electronic device as claimed in claim 1, wherein the control circuit further includes a bias circuit connected to the CPU, the bias circuit includes a second resistor and a third resistor connected in series between a power supply and the audio receiving contact.

* * * * *